United States Patent [19]

Schuster et al.

[11] Patent Number: 4,718,226

[45] Date of Patent: Jan. 12, 1988

[54] FRICTION ROTOR FOR THE FALSE TWISTING OF SYNTHETIC THREADS

[75] Inventors: Friedrich Schuster; Hans Hermanns, both of Hammelburg; Wolfgang Rader, Schonungen, all of Fed. Rep. of Germany

[73] Assignee: FAG Kugelfischer Georg Schafer, Fed. Rep. of Germany

[21] Appl. No.: 931,177

[22] Filed: Nov. 14, 1986

[30] Foreign Application Priority Data

Nov. 16, 1985 [DE] Fed. Rep. of Germany ... 8532434[U]

[51] Int. Cl.[4] ..... D02G 1/04; D01H 7/92

[52] U.S. Cl. ..... 57/340; 57/337

[58] Field of Search ..... 57/339, 340, 348, 337

[56] References Cited

U.S. PATENT DOCUMENTS 3,901,011 8/1975 Schuster ..... 57/339

4,051,655 10/1977 Lorenz et al. ..... 57/348 X 4,129,980 12/1978 Dillon ..... 57/348 X

*Primary Examiner*—Donald Watkins

*Attorney, Agent, or Firm*—Ostrolenk, Faber, Gerb & Soffen

[57] ABSTRACT

A device for the false twisting of synthetic threads is provided with a plurality of friction rotors, each constructed of a reusable central bore and an expendable composite ring that is form-fitted and force-fitted to said base so as to be conveniently removable therefrom for replacement when the friction coating along the outer edge of the ring has worn.

9 Claims, 6 Drawing Figures

FIG. 3.
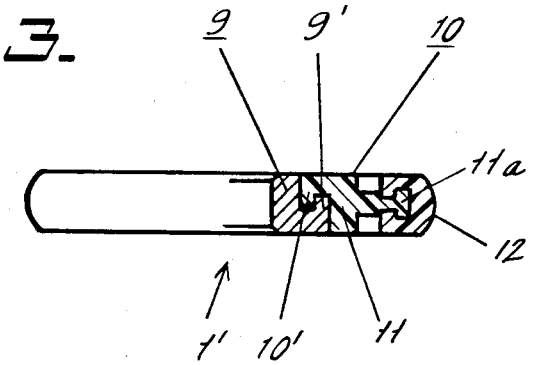
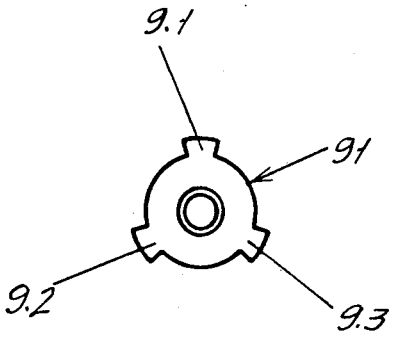
FIG. 5.
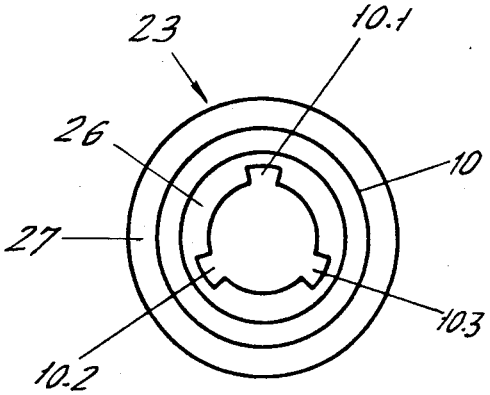
FIG. 6.
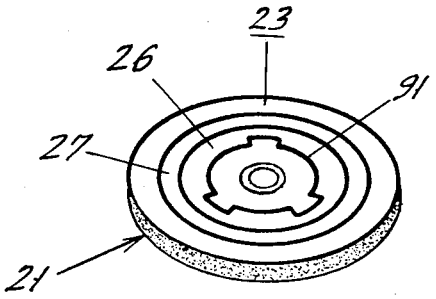
FIG. 4.

FRICTION ROTOR FOR THE FALSE TWISTING OF SYNTHETIC THREADS

BACKGROUND OF THE INVENTION

This invention relates to friction rotors for the false twisting of synthetic threads.

Utilization of friction rotors or disks for the production of false-twisted synthetic threads by utilizing a so-called false-twisting unit is generally known. Typically these friction rotors are constructed of a PUR-plasma-coating full ceramic or a nickel-diamond coating. In comparison with a nickel-diamond coated rotor, the life of a PUR-friction rotor is very short. As a practical matter, regeneration of these friction coverings is impossible.

The prior art has attempted to design a so-called throw-away disk for false-twisting of synthetic threads constructed so that the central base support portion of the disk can be reused. Federal Republic of Germany OS No. 29 01 408 describes a friction rotor which comprises a support part and a replaceable friction covering ring. Unfortunately, it has been found that with increasing speeds of rotation the friction covering ring in the construction of German OS No. 29 01 408 becomes loose from the support so that it no longer assures satisfactory operation of the false-twisting unit.

German Utility Model No. 76 23 421 discloses a friction rotor in which there is a shrink connection between the friction covering and the base support. Use of a shrink connection makes it inconvenient to replace a worn part, and with a shrink connection the friction covering loosens from its support as a result of temperature changes, different coefficients of expansion of the materials, and the action of corrosive scrooping agents. In the case of a three-part disk in which the support is placed on a sleeve, it has been observed that the latter becomes detached from the support after a relatively short period of operation.

SUMMARY OF THE INVENTION

In accordance with the instant invention a friction rotor consists of a central base support that is force-locked and form-locked to a composite ring by utilizing press fitted radially arranged shoulders or dovetail-shaped retainers. The composite ring is formed of an inner support part at least a portion of which is provided with a covering. When the friction covering has become worn, the composite ring can be separated from the base without great difficulty and replaced by a new one, yet the central base, support ring and friction covering remain tightly engaged over an extended period of use.

OBJECTS OF THE INVENTION

Accordingly, a primary object of the instant invention is to provide apparatus for the false-twisting of synthetic threads with a friction rotor that is convenient to replace and has a long operating life.

Another object is to provide a friction rotor of this type that consists of a central base and a replaceable composite ring that includes a friction covering along the periphery thereof.

Another object is to provide a friction rotor of this type having a base and composite ring that are form-locked and force-locked to each other.

A further object is to provide a friction rotor of this type in which locking is achieved by interengagement of cooperating shoulders on the base and composite member.

A still further object is to provide a friction rotor of this type in which the connection between the base and composite member is achieved by dovetail formations that project radially outward from the base and are achieved by complementary cutouts of the composite member.

BRIEF DESCRIPTION OF THE DRAWINGS

These objects as well as other objects of this invention shall become readily apparent after reading the following description of the accompanying drawings in which:

FIG. 3 is a side elevation, partially sectioned, of one of the friction rotors in FIG. 1;

FIG. 4 is a perspective of a friction rotor constructed in accordance with a second embodiment of the instant invention;

FIG. 5 is a plan view of the base of the friction rotor illustrated in FIG. 4; and FIG. 6 is a plan view of the replaceable composite ring of the rotor of FIG. 4.

DETAILED DESCRIPTION OF THE PREFERRED EMBODIMENT

Figure 1:
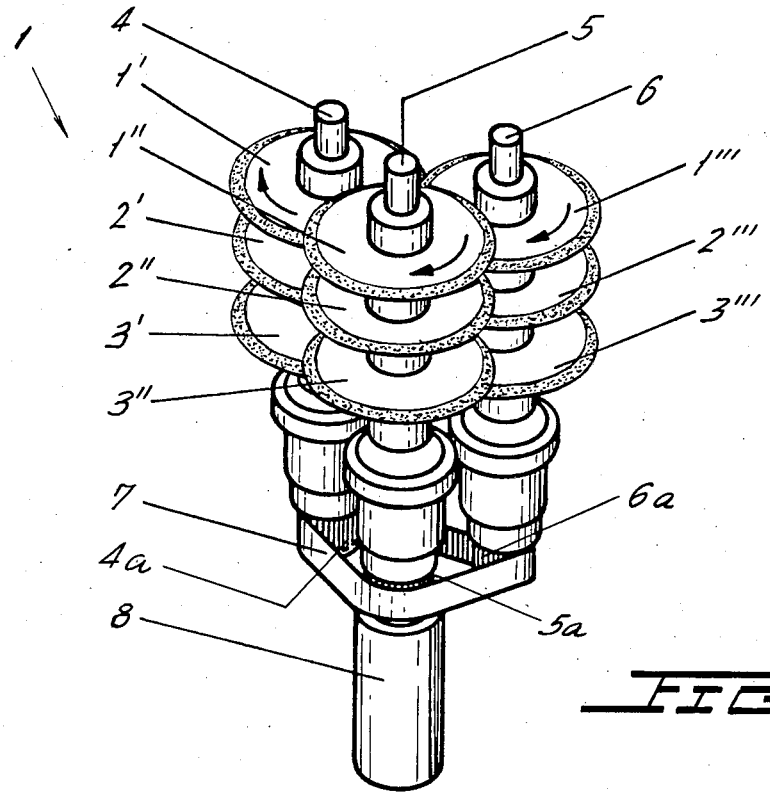
FIG. 1 is a perspective of a false-twisting unit that includes friction rotors constructed in accordance with teachings of the instant invention.
Figure 2:
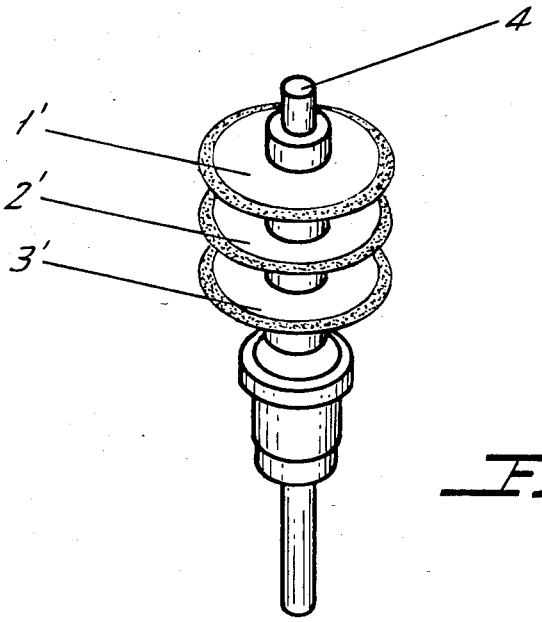
FIG. 2 is a perspective of one of the rotor supporting shafts of FIG. 1, together with elements that are mounted on said shaft.

Now referring to the figures and more particularly to FIGS. 1–3. False-twisting unit 1 of FIG. 1 includes three vertical shafts 4, 5, 6, each mounting three composite friction disks or rotors. That, is rotors 1', 2', 3' are keyed to shaft 4, rotors 1'', 2'', 3'' are keyed to shaft 5, and rotors 1''', 2''', 3''' are keyed to shaft 6.

Keyed to the respective shafts 4, 5, 6 below their respective bottom rotors 3', 3'', and 3''' are the respective pinions *4a, 5a, 6a* whose teeth are engaged by the teeth of closed loop timing belt 7. Driving power for false-twisting unit 10 is introduced through drive whorl 8 that is keyed to shaft 5 below pinion *5a* so that whorl 8 drives shaft 5 directly, and acting through timing belt 7 and pinions *4a, 5a, 6a* drives shafts 4 and 6 in synchronization with shaft 5.

All of the friction rotors 1', 2', 3' etc. of FIGS. 1 and 2 are of the same construction, which is explained in detail with reference to FIG. 3 which illustrates rotor 1'. The latter includes base disk 9 and replaceable composite ring 10 that is removably mounted on base 9. Ring 10 includes annular support part 11 having peripheral formation *11a* that is embedded in friction covering 12. The inner edge of support part 11 is provided with annular shoulder 10' that is force-locked and form-locked to annular shoulder 9' of base 9. The connection between shoulders 9', 10' remains secure for extended periods of operation, yet is convenient to break so that expendable composite ring 10 may be replaced after friction covering *11a* is worn away. The base 9 extends radially past one axial side of shoulder 10', and the ring 10 extends radially past one axial side of shoulder 9'. As a result, the base 9 and ring 10 are movable together into frictional engagement by relative axial movement in one direction and are separable by relative axial movement in the opposite direction.

Now referring more particularly to FIG. 4 which illustrates another embodiment of this invention wherein rotor 21 consists of base 91 (FIG. 5) and replaceable ring component 23 which includes plastic support 26 and friction coating 27 along the outer periphery of support 26. Dovetail projections 9.1, 9.2, 9.3 extend radially outward from base 91 and are received by dovetail recesses 10.1, 10.2, 10.3 which extend from the inner edge of member 26. Dovetail projections 9.1, 9.2 and 9.3 cooperate with recesses 10.1, 10.2, 10.3 to provide a force-fitted and force-locked connection between base 91 and ring 23, which connection may be broken when desired for replacement of composite member 27. As in the first embodiment of FIG. 3, the base 91 and the ring 23 are separable by relative axial movement of one off the other and are brought together by relative axial movement of one toward the other to bring them together and into frictional engagement.

Although the present invention has been described in connection with a preferred embodiment thereof, many variations will now become apparent to those skilled in the art. It is preferred, therefore, that the present invention be limited not by the specific disclosure herein, but only by the appended claims.

What is claimed is:

1. A friction rotor for a false-twisting device, said rotor including:

a reusable base having a periphery and first retaining means along its periphery;

a disposable composite ring having a periphery and a friction covering along its periphery, said ring having a central aperture, and second retaining means adjacent said aperture;

said first and second retaining means being in separable and frictional engagement and cooperating to removably mount said composite ring on said base.

2. A friction rotor as set forth in claim 1 in which:

said first retaining means includes a first shoulder and said second retaining means includes a second shoulder that is form-locked with said first shoulder.

3. A friction rotor as set forth in claim 2 in which the first and second shoulder formations have complementary shapes.

4. A friction rotor as set forth in claim 1 in which one of said first and second retaining means include radial teeth and the other of said first and second retaining means include recesses that receive said teeth and provide a form-locked connection therewith.

5. A friction rotor as set forth in claim 4 in which said teeth are frictionally held within said recesses.

6. A friction rotor as set forth in claim 1 in which said first retaining means includes at least one dovetail formations extending radially outward and said second retaining means includes respective complementary recesses that face radially inward and receive said dovetail formations to provide a form-locked connection therewith.

7. A friction rotor as set forth in claim 6 in which said formations are frictionally held within said recesses.

8. A friction rotor as set forth in claim 1, wherein said first and second retaining means are shaped for enabling said ring to be applied to said base from one axial direction and for enabling said ring to be removed from said base by relative movement therebetween in the opposite direction.

9. A friction rotor as set forth in claim 8, wherein said first retaining means comprises a first shoulder on said base and extending axially in one direction, said second retaining means comprises a second shoulder on said ring and extending in the opposite axial direction, and said first and second shoulders being placed for extending toward and engaging one another as said ring is disposed on said base.

* * * * *